US011585117B2

(12) United States Patent
Redgrave

(10) Patent No.: US 11,585,117 B2
(45) Date of Patent: Feb. 21, 2023

(54) METHOD OF INSTALLING DOOR HARDWARE

(71) Applicant: Roderick Nigel Redgrave, Waitakere (NZ)

(72) Inventor: Roderick Nigel Redgrave, Waitakere (NZ)

( * ) Notice: Subject to any disclaimer, the term of this patent is extended or adjusted under 35 U.S.C. 154(b) by 228 days.

(21) Appl. No.: 16/901,734

(22) Filed: Jun. 15, 2020

(65) Prior Publication Data

US 2021/0388636 A1 Dec. 16, 2021

(51) Int. Cl.

| | |
|---|---|
| ***E05B 15/02*** | (2006.01) |
| ***E05B 17/00*** | (2006.01) |
| ***E05B 17/06*** | (2006.01) |
| ***E05B 9/00*** | (2006.01) |
| *E05C 1/08* | (2006.01) |

(52) U.S. Cl.

CPC ..... *E05B 9/002* (2013.01); *E05B 15/0205* (2013.01); *E05B 17/0004* (2013.01); *E05B 17/06* (2013.01); *E05C 1/08* (2013.01)

(58) Field of Classification Search

CPC .. E05B 9/002; E05B 15/0205; E05B 17/0004; E05B 17/06; E05C 1/08

See application file for complete search history.

(56) References Cited

U.S. PATENT DOCUMENTS

| | | | | |
|---|---|---|---|---|
| 1,272,115 | A | 7/1918 | Russell | |
| 2,862,302 | A | 12/1958 | Lucia | |
| 3,057,053 | A * | 10/1962 | Schlage | E04F 21/003 30/366 |
| 4,023,907 | A | 5/1977 | Chang | |
| 4,065,162 | A * | 12/1977 | Schlage | E05B 15/0205 D8/344 |
| 8,864,188 | B2 | 10/2014 | Redgrave | |
| 2016/0017633 | A1 | 1/2016 | Redgrave | |
| 2016/0305156 | A1* | 10/2016 | Kamody | E05B 15/024 |
| 2018/0038130 | A1 | 2/2018 | Redgrave | |

OTHER PUBLICATIONS www.wikihiow.com/cut-slots-in-wood (Year: 2017).*

Acme Tools, "3 Faster and Better Ways to Make Mortise and Tenon Joints", For The Pros, In the Shop, Woodworking, online at: https://www.acmetools.com/blog/3-ways-cut-mortises-faster-better/; Jun. 2, 2016.

* cited by examiner

*Primary Examiner* — Kristina R Fulton

*Assistant Examiner* — Thomas L Neubauer

(74) *Attorney, Agent, or Firm* — GableGotwals

(57) ABSTRACT

A method of installing a receiving member for a latch assembly or strike assembly in a door or jamb. The receiving member including a base plate, a wall around the perimeter of the base plate, the wall extending substantially perpendicular to the base plate, and a flange extending outwardly from the perimeter of the wall distal the base plate. The base plate has an aperture therein configured to allow a latch to pass therethrough.

10 Claims, 7 Drawing Sheets

METHOD OF INSTALLING DOOR HARDWARE

FIELD OF INVENTION

The invention relates to an improved method of installing door hardware, and to a door and/or door jamb with hardware installed.

BACKGROUND TO THE INVENTION

Swing doors are often hinged along a vertical edge to a door jamb and have a latch assembly, installed in the edge of the door opposite the hinges, which engages with a strike plate installed in the door frame.

A latch bolt is a part of the latch assembly mounted in a hole bored into the door and having a head which fits into a shallow rebate in the surface of the door edge. The latch bolt is able to move in and out of a hole in the head of the latch assembly. Often the latch bolt is spring loaded to urge it to protrude outwards from the edge of the door. The assembly often includes a mechanism that allows someone to retract the latch bolt back into the edge of the door, for example by turning a door handle. Often the end of the latch bolt has an angled or contoured profile on the side that the door closes towards, to allow it to be smoothly pushed back into the door when engaging with the strike plate.

The strike plate fits into a rebate in the door jamb in a position adjacent the latch bolt when the door is closed. The strike plate often has a hole, which when installed is positioned over a hole in the jamb that receives the latch bolt when the door is closed. The strike plate often has a curved lip protruding from its side towards the opening side of the door,—the lip providing a contoured contact surface to smoothly push the latch bolt backwards into the door, allowing the door to shut. The latch bolt can then protrude from the door edge into the hole in the strike plate, preventing the door from opening again, unless the latch bolt is pulled backwards, for example by someone turning a door handle connected to the latch assembly.

Another bolt, independent of the latch bolt is sometimes installed in a door in order to provide a locking mechanism independent of the latch and door handle assembly, for example a dead bolt. A dead bolt is often part of an assembly having a faceplate mounted within the door, and also having a corresponding strike plate, which may be the same strike plate as is associated with the latch bolt, although in such a case the strike plate will have two holes, one for the latch bolt and one for the dead bolt. A dead bolt may not spring loaded and may need to be deliberately moved between the extended position in which it is used to lock the door, and a retracted position in which it is within the door. For this reason, the strike plate corresponding to a dead bolt may not have a contoured lip.

Sliding doors often also have latch bolt type assemblies with heads and corresponding strike plates that fit into recesses in the door. Bolts on sliding doors may have a hooked end to prevent the sliding door being opened unless the bolt is disengaged.

When the door and/or jamb are wooden, it can be time consuming and difficult to install this conventional and widely used hardware because of the need to cut the rebates in the door and door jamb to house the latch head and the strike, respectively.

In particular, where a builder needs to cut the recesses in a door and jamb on the building site, they often only have basic hand tools, and therefore crudely chisel out the recess, which can be a time consuming process and can leave an untidy appearance around the edges of the strike plate.

Latch assemblies and strikes are currently available with heads and strike plates that have curved ends rather than being a rectangular shape. However, to prepare the rebates in the door edge and jamb for a plate with curved ends, more complicated tools are typically required, such as a router and template jig. Such tools are expensive, difficult to transport and use on site and therefore may often not be carried by door installers.

It is one object of the invention to provide an improved method of installing door hardware.

It is an alternative object of the invention to provide an improved door and latch assembly.

It is an alternative object of the invention to provide an improved door jamb and strike assembly.

Alternatively, it is an object of the invention to address at least one of the foregoing problems or at least provide the public with a useful choice.

SUMMARY OF THE INVENTION

According to a first aspect of the invention, there is provided a method of installing a receiving member for a latch assembly or strike assembly in a door or jamb, the receiving member comprising a base plate, a wall around the perimeter of the base plate, the wall extending substantially perpendicular to the base plate, and a flange extending outwardly from the perimeter of the wall distal the base plate, wherein the base plate has an aperture therein configured to allow a latch to pass therethrough, the method comprising the steps of:

creating a recess in the door or jamb by drilling a plurality of substantially parallel bores in the door or jamb substantially perpendicular to a face of the door or jamb through which the bores extend, each bore having substantially the same diameter, wherein the centres of the bores are collinear and wherein a ratio of:

a) the distance between the centre of each bore and the centre of an adjacent bore; to b) the diameter of the bores, is less than or equal to 2:5, wherein the recess so formed comprises a plurality of cusps, the method further comprising the step of inserting the receiving member into the recess such that the base plate is within the recess, the wall engages the cusps and the flange extends over the face of the door or jamb.

Preferably the method comprises the steps of:

i) drilling a first set of the bores, wherein a ratio of:

a) the distance between the centre of each bore of the first set of bores and the centre of an adjacent bore of the first set of bores; to b) the diameter of the bores, is greater than 2:5, and ii) drilling a second set of bores between adjacent ones of the first set of bores.

Preferably the method comprises drilling five bores.

Preferably the method comprises drilling a central bore which is deeper than the other bores.

Preferably the central bore is at least twice the depth of the other bores.

Preferably the other bores have a depth substantially equal to the height of the wall of the receiving member.

Preferably the method comprises drilling pilot holes for each of the bores prior to drilling any of the bores.

Preferably the method comprises positioning a template on the face of the door or jamb, wherein the template comprises a pilot hole aperture for each pilot hole, wherein the method further comprises drilling the pilot holes through the pilot hole apertures.

According to a second aspect of the invention there is provided a method of installing a latch assembly in a door comprising the steps of installing a receiving member for a latch assembly by the method of the first aspect of the invention and installing a latch body through the aperture in the base plate.

According to a third aspect of the invention there is provided a method of installing a strike assembly in a door jamb comprising the steps of installing a receiving member for a strike assembly by the method of the first aspect of the invention and engaging a strike plate with the receiving member.

According to a further aspect of the invention there is provided a door, the door having a recess in an end face thereof, the recess having two opposing sides defined by a plurality of arcs, the arcs defining a plurality of cusps, the door further comprising a latch assembly comprising:

a receiving member comprising a base plate with an aperture therethrough, a wall around the perimeter of the base plate, the wall extending substantially perpendicular to the base plate, and a flange extending outwardly from the perimeter of the wall distal the base plate; and a latch mechanism extending through the aperture in the base plate, wherein the receiving member is positioned within the recess such that the wall of the receiving member engages cusps on opposing sides of the recess, and wherein the flange of the receiving member extends over the end face of the door beyond the recess such that the recess is not visible.

Preferably, the recess has semi-circular ends and the wall of the receiving member engages the ends.

According to a still further aspect of the invention there is provided a doorjamb, the door jamb having a recess in an inner face thereof, the recess comprising two opposing sides defined by a plurality of arcs, the arcs defining a plurality of cusps, the door jamb further comprising a strike assembly comprising a receiving member comprising a base plate with an aperture therethrough, a wall around the perimeter of the base plate, the wall extending substantially perpendicular to the base plate, and a flange extending outwardly from the perimeter of the wall distal the base plate; and a strike plate engaged with the receiving member, wherein the receiving member is positioned within the recess such that the wall of the receiving member engages cusps on opposing sides of the recess, and wherein the flange of the receiving member extends over the inner face of the door jamb beyond the recess such that the recess is not visible.

Preferably, the recess has semi-circular ends and the wall of the receiving member engages the ends.

According to a still further aspect of the invention, there is provided a method of installing a receiving member for a latch assembly or strike assembly in a door or jamb, the receiving member comprising a base plate, a wall around the perimeter of the base plate, the wall extending substantially perpendicular to the base plate, and a flange extending outwardly from the perimeter of the wall distal the base plate, wherein the base plate has an aperture therein configured to allow a latch to pass therethrough, the method comprising the steps of:

creating a recess in the door or jamb by drilling a plurality of substantially parallel bores in the door or jamb substantially perpendicular to a face of the door or jamb through which the bores extend, each bore having substantially the same diameter, wherein the centres of the bores are collinear and wherein a ratio of:

a) the distance between the centre of each bore and the centre of an adjacent bore; to b) the diameter of the bores, is less than or equal to 2:5, wherein the recess so formed comprises a plurality of cusps, the method further comprising the step of inserting the receiving member into the recess such that the base plate is within the recess, the wall engages the cusps and the flange extends over the face of the door or jamb, wherein a pilot hole is drilled for each of the bores.

Further aspects of the invention, which should be considered in all its novel aspects, will become apparent to those skilled in the art upon reading of the following description which provides at least one example of a practical application of the invention.

BRIEF DESCRIPTION OF THE DRAWINGS

One or more embodiments of the invention will be described below by way of example only, and without intending to be limiting, with reference to the following drawings, in which.

BRIEF DESCRIPTION OF PREFERRED EMBODIMENTS OF THE INVENTION

Figure 1:
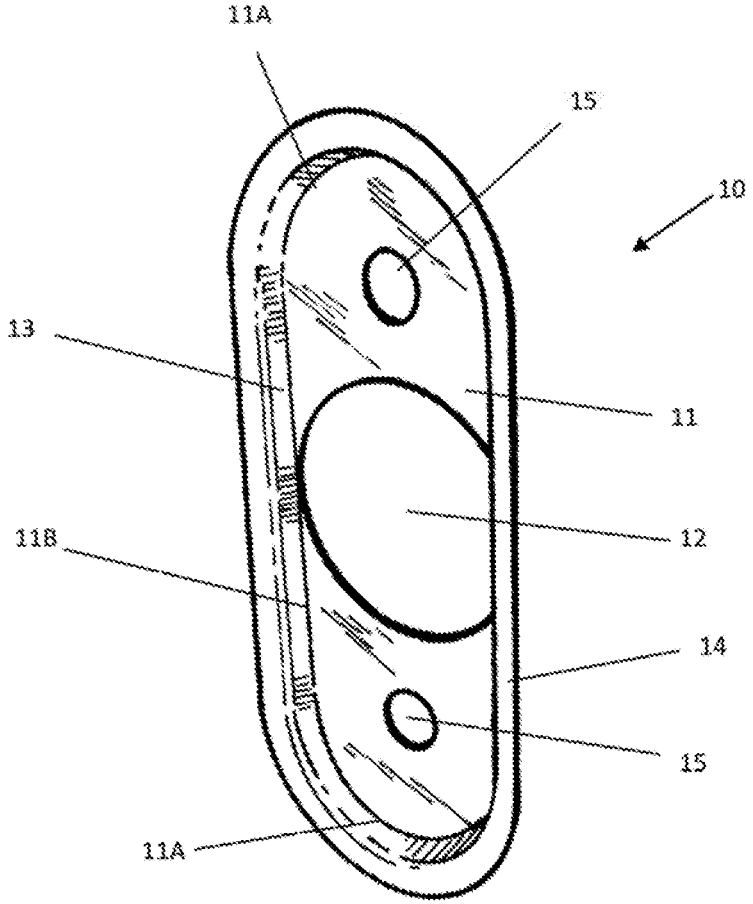
FIG. 1 is a perspective view of a receiving means according to an embodiment of the invention.

FIG. 1 shows a perspective view illustration of a receiving member 10 for a latch or strike assembly. The receiving member 10 comprises base plate 11 in the form of a substantially planar body portion, with a hole 12 in the middle thereof. The hole may have a diameter which is substantially the same as the width of the base plate 11. In other embodiments the diameter of the hole may be less than the width of the base plate. The hole 12 is of sufficient size to allow the latch or bolt of a door latch mechanism to pass therethrough. The hole may be only slightly bigger than the width of the latch.

The base plate 11 has semi-circular ends 11A and straight, parallel sides 11B tangent to the semi-circular ends. Around the perimeter of the base plate 11 is wall 13 extending away from and substantially perpendicular to the base plate 11. The wall 13 therefore comprises the same outer shape as the base plate 11. At the top of the wall 13, distal the base plate 11, is a flange 14, which extends outwardly around the perimeter of the wall on the opposite side of the wall to the base plate. The flange 14 lies in a plane which is substantially parallel to the base plate 11. Concentric with each semi-circular end of the base plate 11 are fastener holes 15.

In the embodiment shown the length of base plate is between two and three times the width dimension.

The receiving member 10 is configured to fit within an appropriately sized recess formed in the edge of a door or in a door jamb, and to receive other parts which may be used in the end face of a door or in a door jamb, such as a latch assembly or a strike assembly, as is described further below.

In preferred embodiments the receiving member is formed of a thin material such as steel sheet having a thickness of less than 1 mm, such as 0.25 mm.

Figure 2:
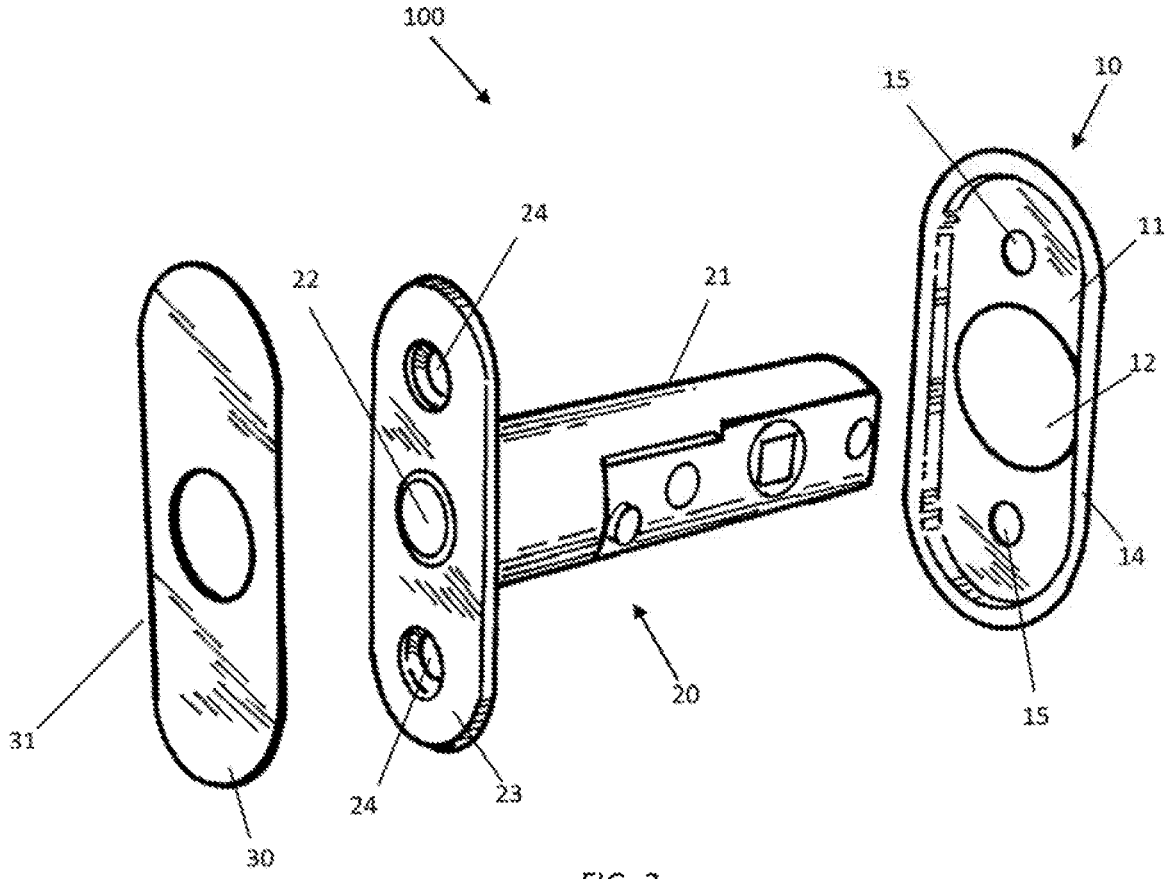
FIG. 2 is an exploded perspective view of a latch assembly comprising the receiving means of FIG. 1.

FIG. 2 shows an exploded perspective view illustration of a latch assembly 100 according to a preferred embodiment of the invention. The latch assembly 100 comprises a receiving member 10 as has been previously described with reference to FIG. 1, a latch 20, and optionally a cover 30. The latch 20 comprises a latch body 21 which houses the mechanism for allowing and controlling movement of a latch bolt 22 relative to the latch body 21. The latch 20 comprises a latch head 23 at the end of the latch 20 from which the latch bolt 22 extends.

The latch head 23 has a size and shape such that it is configured to fit within the recess defined by the base plate 11 and the wall 13 of the receiving member 10. The receiving member 10 can therefore receive and locate the latch 20, by receiving the latch body 21 through the hole 12, and can receive the latch head 23 within the space formed between the base plate 11 and the wall 13. The latch head 23 has a thickness sized such that when latch 20 and receiving member 10 are assembled and the surface of the latch head 23 on the same side as the latch body 21 is in abutment with the base plate 11, the top surface of the flange 14 is substantially coplanar with or protrudes beyond the latch head 23. In this embodiment the top surface of the flange 14 extends beyond the latch head 23 to allow for a cover 30 to be placed over the surface of the latch head 23 opposite the latch body 21. The cover 30 is a substantially planar member sized and shaped to fit inside the walls of receiving member 10 and has a central hole 31 that allows the latch bolt 22 to extend therethrough.

The latch head 23 comprises two fastener holes 24 which are positioned to correspond to fastener holes 15 in the receiving member 10. Fasteners such as screws can therefore be used to mount the latch 20 and receiving member 10 together in the edge of a door, via fastener holes 24 and 15. The cover 30 can then be adhered (or magnetically attracted) to the outer surface of the latch head 23 to conceal the screws, which may improve the aesthetic appearance of the latch assembly 100.

In the embodiment shown in the figures the latch 20 is a magnetic style latch. The latch bolt 22 is biased, for example spring-loaded, towards a retracted position in which the latch bolt 22 is substantially flush with the surface of the latch head 23. There is a magnet in the latch bolt 22 configured such that the latch bolt 22 can be attracted to a magnet configured appropriately in a strike mounted in a door jamb, for example. This way, when the door in which the latch 20 is installed is open, the bias mechanism urges the latch bolt 22 to the retracted position, allowing the door to be closed. When the door is closed such that the latch 20 is adjacent a strike assembly, a latch bolt 22 can then be attracted to a magnet in the strike assembly, pulling the latch bolt 22 into the extended position such that it is received by the strike assembly, preventing the door from opening. The latch body 21 comprises any mechanism that allows the latch bolt 22 to be retracted when the door is to be opened—for example the latch body 21 may comprise a mechanism connected to a door handle adapted to pull back the latch bolt 22 when the door handle is turned, as is known in the art.

Figure 3:
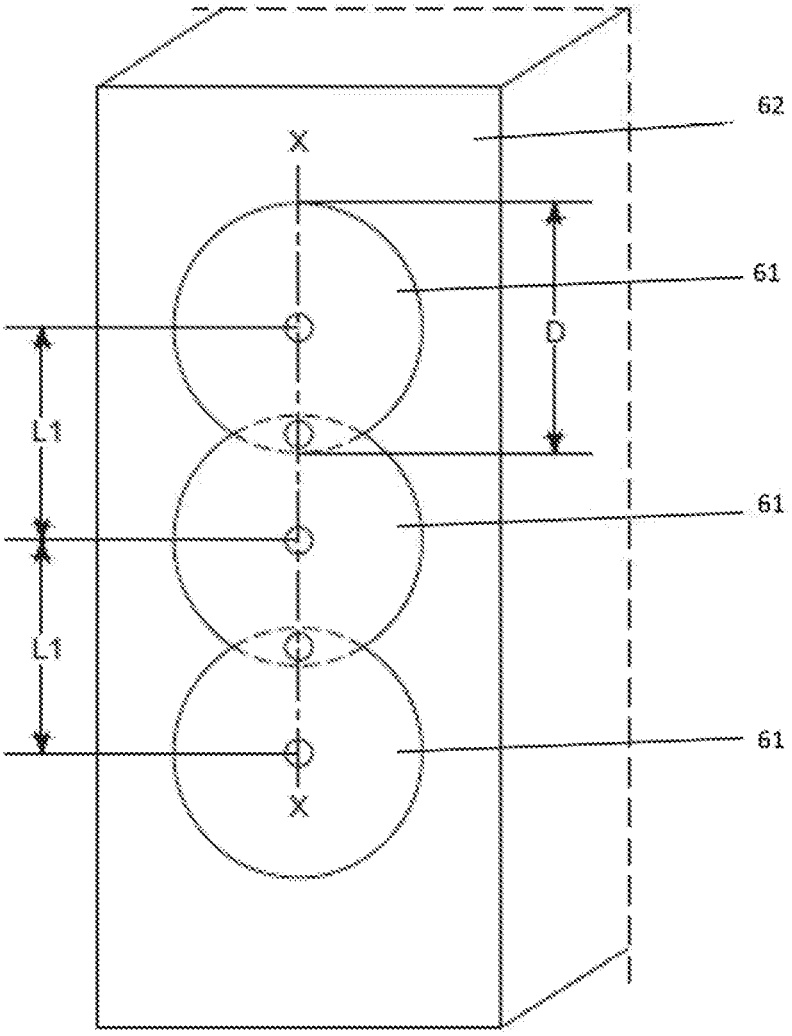
FIG. 3 shows a first set of bores in an end face of a door, in accordance with a method of the present invention.
Figure 4:
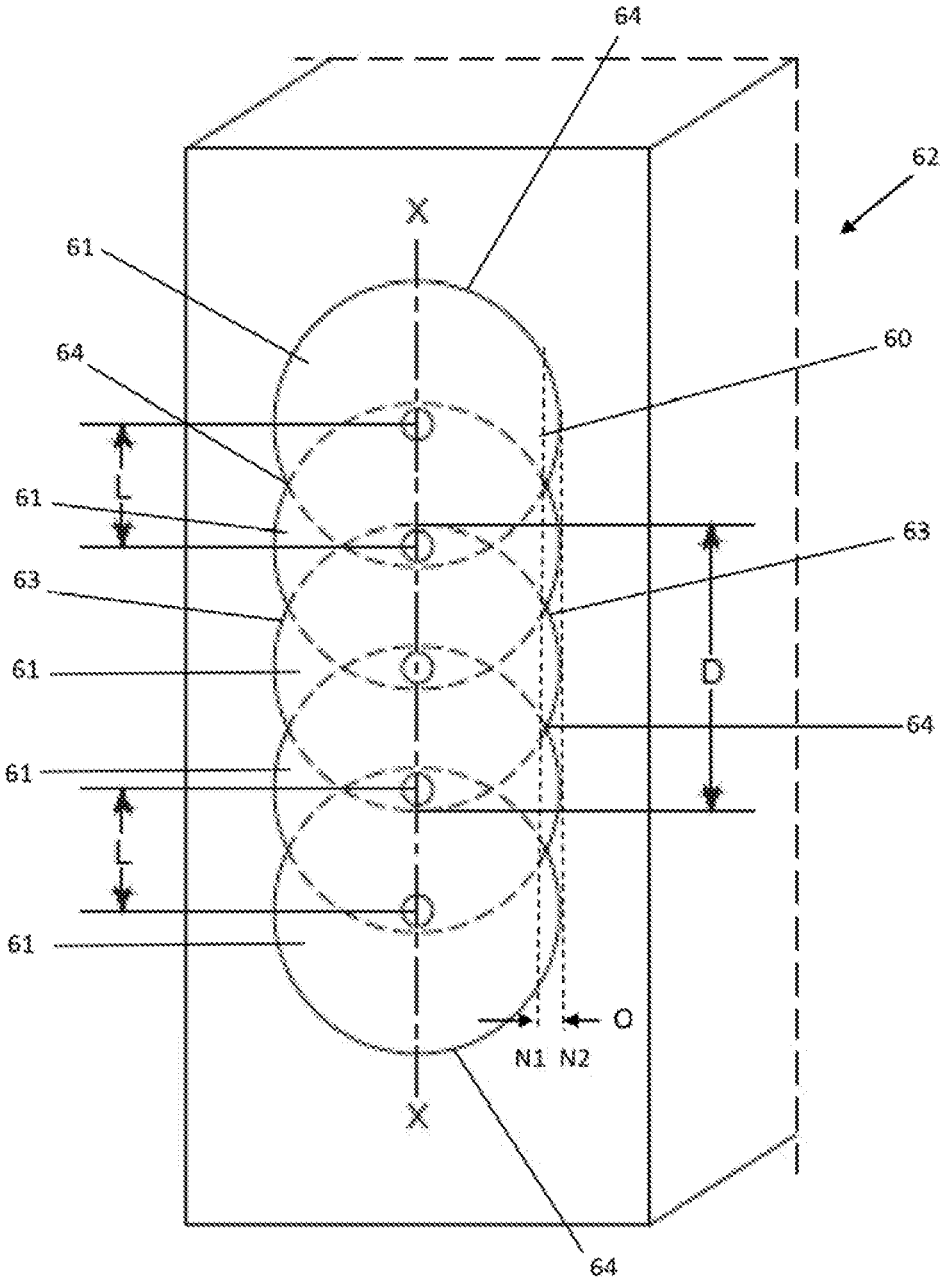
FIG. 4 shows a recess created in accordance with a method of the present invention.
Figure 5:
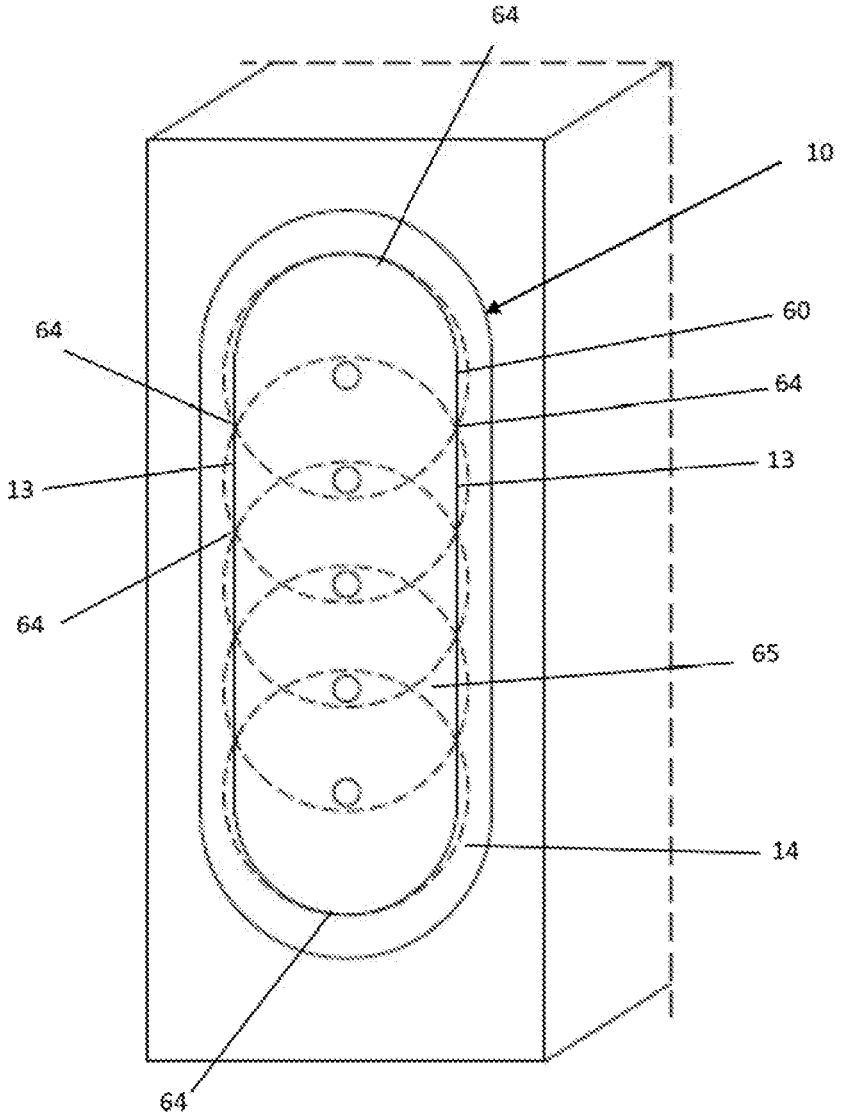
FIG. 5 shows the receiving member of FIG. 1 installed in a recess formed by a method of the present invention, with the recess shown in hidden detail.

A method of installing the receiving member is illustrated in FIGS. 3-5. The method comprises creating a recess 60 by drilling a plurality of substantially parallel bores 61 in a face 62 of the door or jamb to which the door hardware is to be installed. The bores 61 are preferably drilled substantially perpendicular to the face 62 of the door or jamb. The centres of the bores 61 lie on the same line X-X, that is, they are collinear. The bores 61 all have substantially the same diameter D and the centres of the bores 61 are preferably evenly spaced apart by a distance L. The ratio (L:D) of the distance L between the centres of adjacent bores 61 to the diameter D of the bores 61 is preferably 2:5 or less. In one embodiment the bores 61 have a diameter D of substantially 25 mm and the spacing L between the bore centres is substantially 10 mm.

Creating a recess 60 according to the above method results in an elongate recess 60 with rippled or scalloped elongate sides 63 defined by a plurality of curves, and semi-circular ends 64, as shown in FIG. 4. Cusps 64 are created at the intersections of adjacent bores 61 (i.e. at the intersection of the curves). In the embodiment described immediately above, a first notional line N1 through the cusps of one side of the recess 60 is offset from a second notional line N2 which is tangent to the bores 61 on the same side of the recess 60 by a distance O of substantially 1 mm. In this embodiment the ratio of the distance O to the diameter D of the bores 61 is around 1:25.

For embodiments where the ratio L:D is smaller than 2:5, the ratio of the distance O to the diameter D will be correspondingly smaller, that is, the sides of the recess 60 will more closely resemble a straight line.

Once the recess 60 has been prepared, the receiving member 10 can be inserted into the recess 60, as shown in FIG. 5. Notably, in preferred embodiments, once the bores 61 have been drilled no further treatment or preparation of the recess 60 is required before the receiving member can be inserted into the recess 60. In particular, no chiseling or routing operations are required.

The receiving member is dimensioned such that the wall 13 snugly engages the cusps 64 on both sides of the recess 60 and extends to the semi-circular ends of the recess 60. The flange 14 is dimensioned to extend beyond the recess 60, so that no part of the recess 60 is visible when the receiving member 10 is in place.

In some embodiments a central one 65 of the bores 61 is deeper than the remainder of the bores 61. In embodiments, the central bore 65 may be twice the depth of the other bores 61, or more than twice the depth. The other bores 61 preferably have a depth which is substantially equal to the height of the wall. In one embodiment the height of the wall is substantially 4 mm, although other heights are possible. In other embodiments the bores 61 may all be substantially the same depth.

The bores 61 may be drilled in any order. However, in one preferred embodiment a first set of bores 61 is drilled with a ratio (L:D) of the distance L1 between the centres of adjacent bores 61 to the diameter D of the bores 61 being greater than 2:5, as shown in FIG. 3. A second set of bores 61 is then drilled, a bore of the second set being located between each pair of the bores 61 in the first set, as shown in FIG. 4.

In preferred embodiments the recess 60 consists of a total of five bores 61. In the embodiment described immediately above, there may be three bores 61 in the first set of bores 61 and two bores 61 in the second set of bores 61.

It will typically be necessary for pilot holes to be drilled before the bores 61 defining the recess 60 are drilled. The bores 61 are preferably drilled using a drill bit with a long guide centre point, e.g. a spade bit or a forstner bit with a centre twist drill pilot bit, in order to ensure that the drill bit stays engaged with the pilot hole and does not slip sideways.

Figure 6:
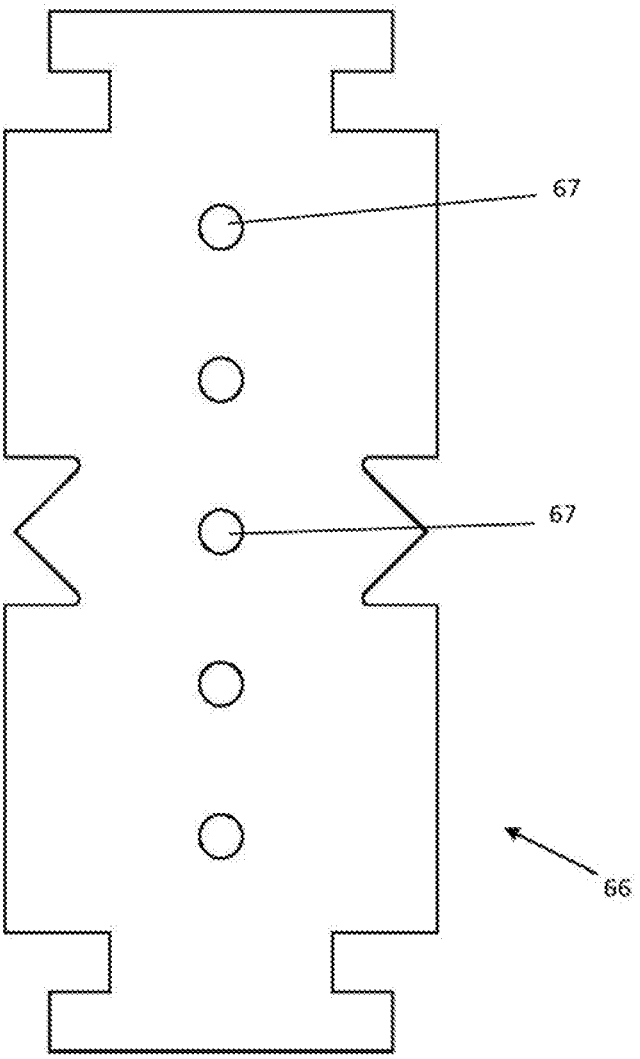
FIG. 6 shows a template for use with the method of the invention.

In one embodiment a template 66 is provided for the pilot holes, as shown in FIG. 6, and the method comprises positioning the template 66 on the face of the door or jamb and drilling the pilot holes through pilot hole 67 apertures in the template 66.

Referring back to FIG. 2, once the receiving member 10 is installed in the recess 60, the latch can be installed (e.g. with the latch body being received by the deeper central recess 65) and, where provided, the cover 30 can be installed over the latch head.

Strike Assembly

Figure 7:
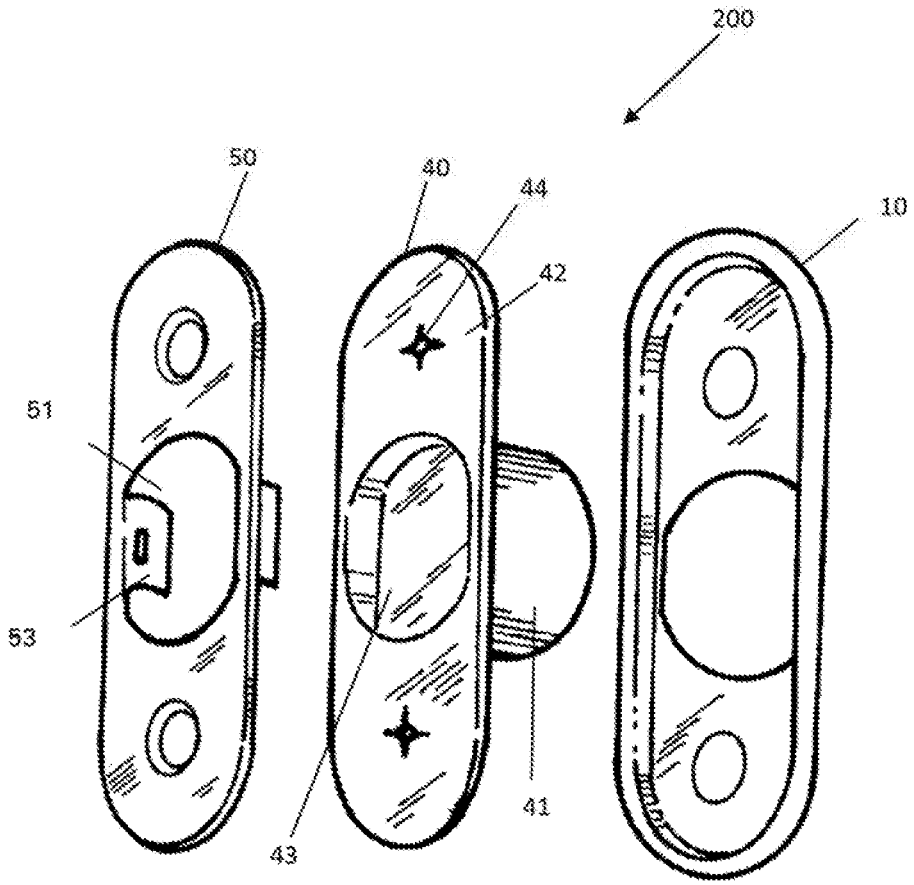
FIG. 7 is an exploded perspective view of a strike assembly comprising the receiving means of FIG. 1.

Referring next to FIG. 7, an exploded perspective view of a magnetic strike assembly 200 is shown, the assembly comprising the receiving member 10, a magnetic member 40 and a strike plate 50. The strike assembly 200 can be installed in a recess of a door jamb, for example a recess 60 as described above.

Magnetic member 40 comprises a body having a central portion 41 and a planar portion 42. Planar portion 42 extends perpendicularly from the central portion 41 on two opposing sides thereof. In the embodiment shown the planar portion 42 extends from one end of the central portion 41 such that the corresponding end of the magnetic member is substantially flat. The shape of planar portion 42 is therefore formed by two straight sides and two semi-circular ends, the straight sides each being tangent to both semi-circular ends. There is a central hole 43 formed through the planar portion 42 and into the central portion 41.

The size and shape of the planar portion 42 and central portion 41 of the magnetic member 40 preferably correspond to the internal size and shape of the receiving member 10. The magnetic member 40 can therefore be received by the receiving member 10, with the fastener holes 44 and fastener holes 15 being aligned.

The thickness of the planar portion 42 of the magnetic member is less than the height of the wall 13 of the receiving member. This allows for the plate 50 to be placed over the magnetic member 40 when assembled with the receiving member 10, without the plate 50 protruding beyond the flange 14 of the receiving member 10.

In embodiments where the magnetic member 40 forms part of the strike assembly 200, a magnet is secured within the central portion 41 of the magnetic member, for example inside hole 43 in the side of central portion 41 with an opening co-planar with planar portions 42. The magnet is configured such that its position and orientation attracts a magnetic latch bolt, for example latch bolt 22, to provide the function and associated advantages described above with reference to the magnet in the latch bolt 22. The magnet in the magnetic member 40 may have a protective covering over the surface towards which the latch bolt 22 extends, allowing the end of the latch bolt to contact that protective covering without damaging the magnet. The protective covering in preferred embodiments is a foam or foam like material. The depth of the surface of the magnet or protective covering within hole 43 may be varied by some means, for example by placing a spacer member into hole 43 under the magnet or covering.

In the embodiment shown the plate 50 is a planar member of the same shape and size as the planar portion 42 of the magnetic member 40. The plate 50 is preferably formed from steel sheet having a thickness of 1 mm or 1.2 mm or similar. The plate 50 has a central hole 51 which can be aligned with hole 43 of the magnetic member 40, and two fastener holes 52 aligned with the guide holes 44 of the magnetic member 40. The central hole 51 has straight sides which, when the plate 50 is assembled with the magnetic member 40, are parallel with the straight sides of the magnetic member 40. On the inside of the straight sides of the hole 51 are two tabs 53 which extend perpendicular to the planar body of the plate 50, in a direction such that they extend into the hole 43 of the magnetic member 40 when the plate 50 and magnetic member 40 are assembled. These tabs 53 aid in locating the plate 50 during installation, and can be bent as required to reduce any freedom of the latch bolt 22 to move or rattle (i.e. reduce or eliminate play) within the strike 200.

After the strike assembly 200 has been installed in a door jamb and secured with screws, a cover, which may be a cover 30 as was described with reference to FIG. 2, can then be adhered to the outer surface of the plate 50 to conceal the screws, which may improve the aesthetic appearance of the strike assembly 200.

In embodiments which use a non-magnetic latch, the magnetic member 40 may be omitted from the strike assembly described above, Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavour in any country in the world.

The invention may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

The invention claimed is:

1. A method of installing a latch assembly in a door, the latching assembly comprising a receiving member, the receiving member comprising a base plate having semi-circular ends, a wall around the perimeter of the base plate, the wall extending substantially perpendicular to the base plate, and a flange having semi-circular ends and extending outwardly from the perimeter of the wall distal the base plate, wherein the base plate has an aperture therein configured to allow a latch to pass therethrough, the method comprising the steps of:

creating a recess in the door by:

drilling a first set of bores comprising a plurality of substantially parallel bores in the door or jamb substantially perpendicular to a face of the door or jamb through which the bores extend, each bore having substantially the same diameter, wherein the centres of the bores are collinear and wherein a ratio of:

a) the distance between the centre of each bore and the centre of an adjacent bore; to b) the diameter of the bores, is less than or equal to 2:5; and drilling a second set of bores between adjacent ones of the first set of bores creating a plurality of cusps at the intersection of adjacent bores and a scalloped edge along each side of the recess, inserting the receiving member into the recess such that the base plate is within the recess and the wall engages each of the cusps formed by the drilling steps, and the flange extends over the scalloped edge so that no part of the recess is visible; and installing a latch body through the aperture in the base plate.

2. The method of claim 1 comprising drilling five bores.

3. The method of claim 1 comprising drilling a central bore which is deeper than the other bores.

4. The method of claim 3 wherein the central bore is at least twice the depth of the other bores.

5. The method of claim 3 wherein the other bores have a depth substantially equal to the height of the wall of the receiving member.

6. The method of claim 1 wherein the method comprises drilling pilot holes for each of the bores prior to drilling any of the bores.

7. The method of claim 6 wherein the method further comprises positioning a template on the face of the door or jamb, wherein the template comprises a pilot hole aperture for each pilot hole, wherein the method further comprises drilling the pilot holes through the pilot hole apertures.

8. A method of installing a strike assembly in a jamb the strike assembly comprising a receiving member, the receiving member comprising a base plate having semi-circular ends, a wall around the perimeter of the base plate, the wall extending substantially perpendicular to the base plate, and a flange having semi-circular ends and extending outwardly from the perimeter of the wall distal the base plate, wherein the base plate has an aperture therein configured to allow a latch to pass therethrough, the method comprising the steps of:

creating a recess in the jamb by:

drilling a first set of bores comprising a plurality of substantially parallel bores in the door or jamb substantially perpendicular to a face of the door or jamb through which the bores extend, each bore having substantially the same diameter, wherein the centres of the bores are collinear and wherein a ratio of:

the distance between the centre of each bore and the centre of an adjacent bore;

to the diameter of the bores, is less than or equal to 2:5; and drilling a second set of bores between adjacent ones of the first set of bores creating a plurality of cusps at the intersection of adjacent bores and a scalloped edge along each side of the recess;

inserting the receiving member into the recess such that the base plate is within the recess and the wall engages each of the cusps formed by the drilling steps and the flange extends over the scalloped edge so that no part of the recess is visible;

engaging a strike plate with the receiving member.

9. A door having a recess in an end face thereof, the recess having two opposing sides defined by a plurality of arcs, the arcs defining a plurality of cusps at the intersection of adjacent bores and a scalloped edge along each side of the recess, the door further comprising a latch assembly comprising:

a receiving member comprising a base plate having semi-circular ends and with an aperture therethrough, a wall around the perimeter of the base plate, the wall extending substantially perpendicular to the base plate, and a flange having semi-circular ends and extending outwardly from the perimeter of the wall distal the base plate; and a latch mechanism extending through the aperture in the base plate, wherein the receiving member is positioned within the recess such that the wall of the receiving member engages each of the cusps on opposing sides of the recess, and wherein the flange of the receiving member extends over the scalloped edge beyond the recess such that the recess is not visible.

10. The door of claim 9 wherein the recess has semi-circular ends and the wall of the receiving member engages the ends.

* * * * *